US005356020A

United States Patent [19]

Thompson

[11] Patent Number: 5,356,020

[45] Date of Patent: Oct. 18, 1994

[54] CONTAINER CLOSURE WITH TAMPER EVIDENT BAND

[75] Inventor: Nigel Thompson, Norton, United Kingdom

[73] Assignee: MCG Closures Limited, England

[21] Appl. No.: 202,666

[22] Filed: Feb. 25, 1994

Related U.S. Application Data

[63] Continuation of Ser. No. 27,751, Mar. 8, 1993, abandoned.

[30] Foreign Application Priority Data

Mar. 12, 1992 [GB] United Kingdom ..... 9202375.0

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,526,282 | 7/1985 | Dutt et al. | 215/252 |
| 4,541,536 | 9/1985 | Davis et al. | 215/252 |
| 4,715,506 | 12/1987 | McLaren | 215/252 |
| 4,784,280 | 11/1988 | Breuer et al. | 215/252 |
| 4,899,898 | 2/1990 | Thompson | 215/252 |
| 5,131,550 | 7/1992 | Thompson | 215/252 |

FOREIGN PATENT DOCUMENTS

| | | |
|---|---|---|
| 0306259 | 3/1989 | European Pat. Off. . |
| 0408364 | 1/1991 | European Pat. Off. . |
| 9111369 | 8/1991 | PCT Int'l Appl. . |

*Primary Examiner*—Allan N. Shoap
*Assistant Examiner*—Nova Stucker
*Attorney, Agent, or Firm*—Laubscher & Laubscher

[57] ABSTRACT

The present invention provides a container closure molded from plastics material and comprising a crown, an annular skirt depending from the crown and formed with a screw threaded on its internal surface and a tamper evident ring connected to the end of the skirt remote from the crown by a series of frangible bridges extending across an axial gap between the ring and the skirt, or by a band of the material with a circumferential line of weakening therein. The ring has spaced along its inner surface a plurality of radially inwardly projecting protrusions each having an abutment surface generally facing the crown, but having a slight inclination away from the crown in the radially inward direction, and an inwardly facing cam surface inclined away from the crown. The inwardly facing cam surface has a compound curve tapering downwardly from the crown and towards the screwing-on direction, thereby to assist capping.

4 Claims, 1 Drawing Sheet

CONTAINER CLOSURE WITH TAMPER EVIDENT BAND

This application is a continuation, of application Ser. No. 08/027,751, filed Mar. 8, 1993 ABN.

BACKGROUND OF THE INVENTION

The present invention relates to closures for containers.

In EP-A-0408364, there is described a container closure molded from plastics material and comprising a crown, an annular skirt depending from the crown and formed with a screw thread on its internal surface, and a tamper evident ring connected to the end of the skirt remote from the crown by a series of frangible bridges extending across an axial gap between the ring and the skirt, or by a band of the material with a circumferential line of weakening therein. The ring has spaced along its inner surface a plurality of radially inwardly projecting protrusions each having an abutment surface a plurality of radially inwardly projecting protrusions each having an abutment surface generally facing the crown but having a slight inclination away from the crown in the radially inward direction, and an inwardly facing cam surface inclined away from the crown. Whereas this arrangement works satisfactorily there are improvements which can be made to improve its performance.

One of the problems with arrangements of the above type is that in order to provide an adequate abutment surface for contact with the shoulder of security band formed on the neck of the container to which the closure is to be applied, regularly spaced double-ended protrusions are provided at regular intervals about a ring. The effect of this is to reduce the extensibility of the ring because the relative lengths of the protrusions have the side effect of reducing the flexibility and extensibility of the ring. The effect is to require a relatively high torque setting on the capping machine, during assembly with a container neck, in order to force the ring over the security band on the neck of the container during the capping procedure. Because the torque setting of the capping machine has to be high, a further side effect is that the closure is driven onto the container neck by the capping machine such that unscrewing can require significant strength. Further, because of the lack of extensibility there is a certain failure rate among the closures and the capping rate is reduced.

SUMMARY OF THE INVENTION

In order to address this problem, the present invention is characterized in that the inwardly facing cam surface has a compound curve tapering downwardly away from the crown and toward the screwing on direction.

The compound curve may be formed with an inclined surface tapering downwardly from the crown and toward the screwing on direction and a more sharply re-entrant inclined surface directed toward the screwing off direction.

By means of this arrangement, the protrusions in accordance with the present invention can be radially truncated since it has been found that the double ended arrangement of our previous application is not always necessary and that the compound curve of the present invention allows the protrusions to be made relatively shorter in the circumferential direction, thereby increasing the extensibility of the ring to allow a reduction in the capping machine setting for successful application of the closures in accordance with the present invention to a container.

In a preferred form of the invention, the spacing between the protrusions on the inner periphery of the ring exceeds the length of each protrusion. More preferably, the ratio of the spacings between the protrusions and the length of the protrusions per se is between 1:0.66 to 1:0.75.

Preferably the protrusions are so disposed about the central axis of the closure that no two protrusions are diametrically opposed to each other. The protrusions may be uniformly disposed about at least a major portion of the ring. In a particularly preferred form of the invention, the ring has a section of its circumference without any protrusions. In this instance the section is provided with an axial line of weakness thereby to cause the ring to fracture during removal but to be retained with the closure for disposal.

BRIEF DESCRIPTION OF THE FIGURES

The invention will now be described by way of illustration only with reference to FIGS. 1 to 3 of the accompanying drawings wherein.

DETAILED DESCRIPTION

Figure 3:
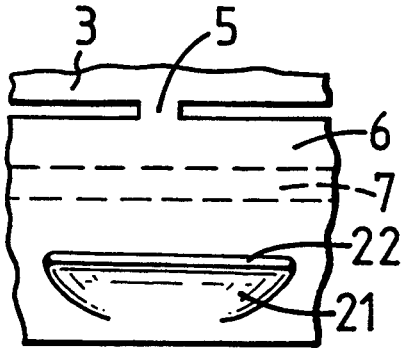
FIG. 3 Prior Art.
FIG. 3 shows a side elevation of a protrusion of the Prior Art in accordance with European Patent Application No. 0408364.

With reference first to FIG. 3, which shows a Prior Art arrangement in accordance with European Patent Publication No. 0408364, there is provided a tamper evident band (6) provided with an annular groove (7) secured to the lower edge of the inner skirt (3) by means of frangible bridges (5). In this Prior Art arrangement double ended protrusions (21) are provided with an upper abutment surface (22) for inter-engagement with the shoulder of a security band portion disposed on the neck of a container (not shown). Abutment surface (22) is radially inwardly disposed and slightly inclined away from the crown portion of the container. The downwardly and inwardly inclined portion (21) has a uniform curved configuration.

Figure 1:
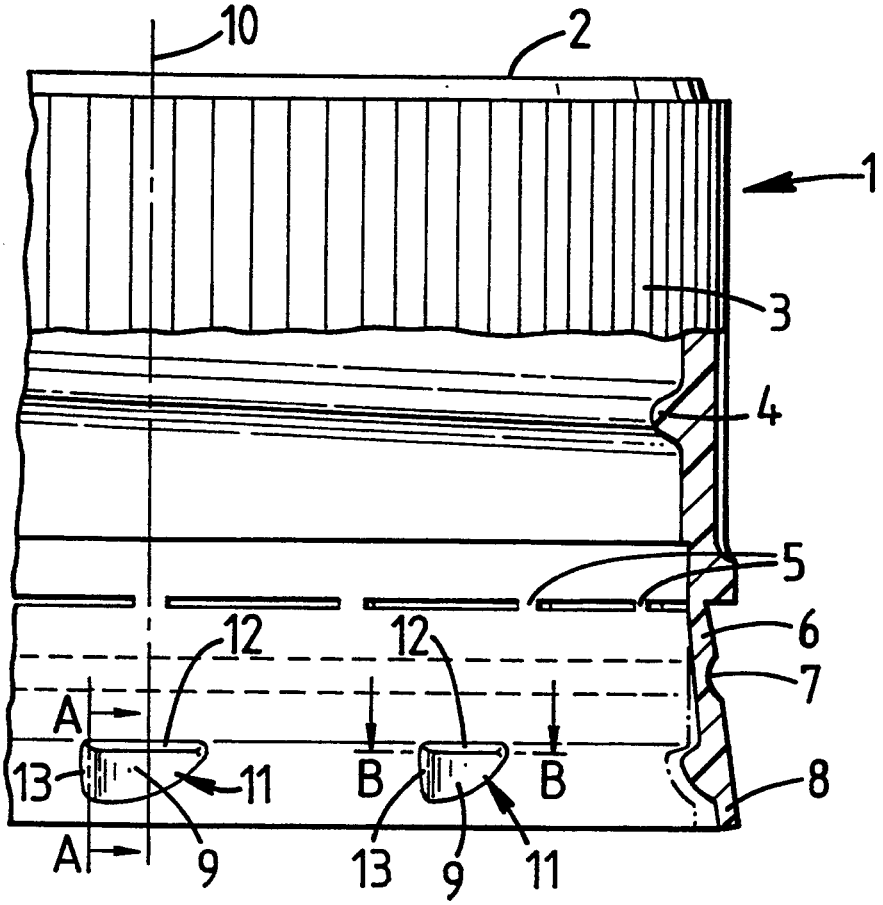
FIG. 1 shows a side elevation in partial section of a closure in accordance with the present invention.

With reference particularly to FIG. 1, a tamper evident closure (1) is formed in accordance with the usual molding procedures with the crown portion (2) from which depends an annular skirt (3) provided on its inner surface with a screw thread portion (4) for engagement with a corresponding screw thread portion on the neck of a bottle or container to which the closure is to be applied. The neck of the container or bottle is also provided with accurately spaced security band (not shown).

At the foot of the annular skirt (3) are provided a plurality of axially directed frangible bridges (5) which interconnect the lower end of the annular skirt (3) with a tamper evident band (6) generally of known construction. The tamper evident band (6) is in this instance provided with an annular groove (7) on its external periphery which allows, during the stripping of the mold at manufacture, the ready outward flexing of the lower hinged skirt portion (8) of the tamper evident band (6).

Figure 2A:
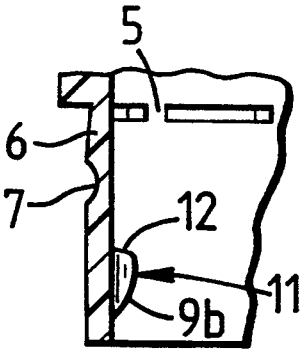
FIG. 2A shows a transverse cross-section along a line AA of FIG. 1.
Figure 2B:
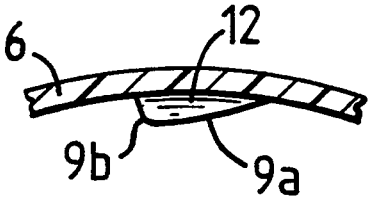
FIG. 2B shows a transverse cross-section along a line BB of FIG. 1.

Disposed at regular intervals at least over a major proportion of the inner circumferential surface of the tamper evident band (6) are a plurality of protrusions (11). The protrusions (11) are each provided with an abutment surface (12) which faces generally upwardly toward the underside of the crown (2) but which is also slightly radially inwardly and relatively downwardly inclined. The protrusion (11) is also provided with a compound curve (9) shown best in FIGS. 2A and 2B. The compound curve (9) extends from the radially inner edge of the abutment surface (12) downwardly towards the lower edge of the tamper evident band (6). The compound curve (9) of the protrusion (11) comprises in the onscrewing direction an extended gentle radius (9*a*), see FIG. 2B, and a smaller radius (9*b*). The major face of the protrusion (11) is also formed with an obverse curve (13) in the offscrewing direction. Obverse curve (13) is much more sharply defined than the other portion of the compound curve (9) as shown in FIG. 2B.

In use the capping machine is provided with a closure in accordance with FIG. 1 and is arranged to introduce the closure onto a container neck by rotary action in accordance with known procedures. In the onscrewing direction (to the right of the lower portion of FIG. 1) the comparatively gentle curve (9*a*) and obverse curve (9*b*) will encounter the security band portion of the neck of the container which rotationally and vertically combine to gently press the ring apart, because of its extensible characteristics by virtue of the relatively wider spacing of the protrusions. Accordingly during the capping procedure, the tamper evident portion (6, 8), swings outwardly from the bridges to accommodate the shoulder of the security band portion before returning to its at rest condition as shown by phantom lines in FIG. 1. Thus, by means of the arrangement in accordance with this invention, the protrusions allow the closure to be readily applied to a container neck with reduced wear and reduced torque settings.

When the closure (1) is first removed from the bottle or container neck it will be unscrewed such that the obverse curve (13) presents a leading edge to the security band portion, and furthermore the sharper definition of curve (13), makes it much more difficult for the ring to 'jump' the shoulder of the security band and hence be withdrawn with the closure without fracture of the frangible bridges (5). Indeed we have found that closures in accordance with FIG. 1 are able to be removed from their container necks in a fashion which ensures that the frangible bridges (5) virtually always fracture.

In EP-A-0306259 there is described a closure of the above type provided with a tamper evident ring having an annular groove disposed on radially outer surface of the ring at a location axially between the upper contact faces of the protrusions and the frangible bridges. This serves as described above and is well suited to arrangements of the invention.

The invention therefore is directed to an improved container closure of the type including an improved tamper evident band, provided with inwardly directed protrusions having a major face comprising a compound curve as hereinbefore described.

What we claim is:

1. A container closure formed of plastics material, comprising:

(a) a crown;

(b) an annular skirt depending from said crown and having a screw thread on an inner surface thereof;

(c) said skirt containing a circumferential line of weakness defining a tamper-evident ring depending from said skirt, said line of weakness including a plurality of spaced frangible bridges adapted to transmit rotational forces arising between said ring and said skirt during an on-screwing process and for connecting said ring with said skirt; and (d) a plurality of integral protrusions extending radially inwardly from an inner surface of said ring, said protrusions being annularly spaced by a distance greater than the length of each protrusion, each protrusion having (1) an abutment surface facing said crown and inclined slightly away from the crown in a radially inward direction; and (2) an inwardly facing cam surface inclined away from said crown, said cam surface having a compound curve including an inclined surface which tapers downwardly from the crown and toward a screw-on direction of the closure and a sharp re-entrant inclined surface which tapers toward a screw-off direction, whereby when the closure is rotated in a screw-off direction, said ring rotates with said skirt until said bridges are fractured owing to axial and rotational forces generated on said protrusions to separate said ring from said skirt.

2. A container closure as defined in claim 1, wherein said protrusions are so disposed about an axis of the closure that no two protrusions are diametrically opposed to each other.

3. A container closure as defined in claim 1, wherein said protrusions are uniformly arranged about at least a major portion of said ring.

4. A container closure formed of plastics material, comprising (a) a crown;

(b) an annular skirt depending from said crown and having a screw thread on an inner surface thereof;

(c) said skirt containing a circumferential line of weakness defining a tamper-evident ring depending from said skirt, said line of weakness including a plurality of spaced frangible bridges for connecting said ring with said skirt; and (d) a plurality of integral protrusions extending radially inwardly from an inner surface of said ring, said protrusions being annularly spaced, the ratio of the spacing between the protrusions to the length of each protrusion being on the order of 1:0.66 to 1:0.75, each protrusion having (1) an abutment surface facing said crown and inclined slightly away from the crown in a radially inward direction; and (2) an inwardly facing cam surface inclined away from said crown, said cam surface having a compound curve which tapers downwardly from the crown and toward a screw-on direction of the closure.

* * * * *